US006241125B1

(12) United States Patent
Jacobsen et al.

(10) Patent No.: US 6,241,125 B1
(45) Date of Patent: Jun. 5, 2001

(54) SYSTEM AND KIT ACCESSORIES FOR DISPENSING REACTIVE TWO COMPONENT MATERIALS

(76) Inventors: Kenneth H. Jacobsen, 921 N. Quentin Rd., Palatine, IL (US) 60067; Louis F. Cole, 21233 Silk Tree Cir., Plainfield, IL (US) 60544

( * ) Notice: Subject to any disclaimer, the term of this patent is extended or adjusted under 35 U.S.C. 154(b) by 0 days.

(21) Appl. No.: 09/430,990

(22) Filed: Nov. 1, 1999

Related U.S. Application Data

(63) Continuation-in-part of application No. 09/392,752, filed on Sep. 7, 1999, now Pat. No. 6,129,249, which is a continuation of application No. 08/740,096, filed on Oct. 24, 1996, now Pat. No. 5,984,152.

(51) Int. Cl.[7] ..... B65D 5/72
(52) U.S. Cl. ..... 222/145.4; 222/495; 425/12
(58) Field of Search ..... 222/145.4, 145.6, 222/137, 327, 495, 559, 575; 401/107, 193, 266; 425/87, 12, 13; 156/94; 285/921

(56) References Cited

U.S. PATENT DOCUMENTS 3,451,393 * 6/1969 Sarnoff ..... 222/145.4
4,496,081 * 1/1985 Farrey ..... 222/145.4
5,433,354 * 7/1995 Jacobsen et al. ..... 222/495
5,984,152 * 11/1999 Jacobsen et al. ..... 222/575
6,129,249 * 10/2000 Jacobsen et al. ..... 222/495

* cited by examiner

*Primary Examiner*—Philippe Derakshani
(74) *Attorney, Agent, or Firm*—Charles F. Lind

(57) ABSTRACT

The invention teaches a kit-like system and apparatus for dispensing a multiple component reactive material from two cartridges each having an exteriorly threaded semi-cylindrical outlet nozzle, where the respective components need not be mixed together immediately, but only in close proximity of the intended use of the material. Thus, the cartridge nozzles will be spaced from one another, and at least one will be paired up with a dummy nozzle having a like exteriorly threaded semi-cylindrical nozzle, but with no outlet. Special universal fittings are provided in the kit that fit over the paired cartridge and dummy nozzles, and over a separate conventional mixer, and further that allow for hoses to be connected thereto, to define separate component flow paths from the separate cartridges to the remotely located mixer and then to the intended discharge location. A clamp on the common discharge flow path can be used for regulating the material discharged from the component cartridges proximate the end use location.

9 Claims, 5 Drawing Sheets

SYSTEM AND KIT ACCESSORIES FOR DISPENSING REACTIVE TWO COMPONENT MATERIALS

RELATED APPLICATION

This is a Continuation-in-Part application of application Ser. No. 09/392,752 filed on Sep. 7, 1999, now 6,129,249 which is a Continuation Application of application Ser. No. 08/740,096 filed on Oct. 24, 1996, which has been allowed and is now U.S. Pat. No. 5,984,152 issued on Nov. 16, 1999.

FIELD OF THE INVENTION

This invention relates to devices usable for dispensing fluid material(s) via conventional dispensing outlet nozzle(s) directly into a surface crack of a structure, such as concrete floors, walls or ceilings.

BACKGROUND OF THE INVENTION

Caulk, adhesive, potting material and other fluid material systems are commonly contained in tubular cartridges of the type having an outlet nozzle at one end and an opposite open end that is closed by a wiper slidably seated against the inside face of the cartridge wall. The material is discharged from the outlet nozzle by advancing the wiper through the cartridge toward the nozzle. Available dispensing tools utilize a plunger connected to a rod, and a power device that forces the rod and plunger axially into the open cartridge end and against the wiper. Many dispensing tools are hand held and portable, where the power device is a ratchet mechanism indexed incrementally upon manual trigger squeezes. Further, a dispensing tool for providing larger capacity or higher pressures of material delivery might be actuated by an air cylinder powered upon shifting a trigger activated open-close valve.

Single component fluid material systems use only one cartridge, the material being discharged therefrom via an elongated dispensing tube having the outlet nozzle at its downstream end. Multiple component fluid material systems use different cartridges from which the separate components forming the material are simultaneously discharged in the precise ratio needed to form the intended composite material, the discharged components being blended together in an elongated mixing/dispensing tube before being discharged as the composite material from the outlet end of the dispensing tube. The different individual components are stable only when maintained separated, but begin to set when blended together and harden to the intended composite material in setting times measured between possibly only a few seconds and several hours (depending on the composite material).

Common multiple component materials include two-part epoxies, urethanes, silicones, phenolics, acrylics and polyesters. Component fluid systems have been successfully used for filling surface cracks in concrete structures to restore structural integrity.

Special conduit routing structures can be fitted over the outlet end of the dispensing tube for more accurately directing the discharged material to the intended region of use. One such routing structure is a tubular surface port device, which has an outlet end with an enlarged base that can be bonded by adhesive to the structural surface with the tube bore aligned over a surface crack. The material dispensing tube is then seated against the inlet tube bore end to funnel the discharged material directly into the underlying crack.

Our U.S. Pat. No. 5,433,354 discloses a port device having great universality to operate effectively with many different types and sizes of dispensing tubes and outlet nozzles used in dispensing fluid material(s) from tubular cartridge(s), while maintaining a leakproof seated fit between the dispensing tube outlet nozzle and port device inlet, and possibly even without the need for physically holding these seated components together with any significant force. The port device tube has its inlet end stepped at adjacent axially extended inner land areas of progressively smaller diameters in the direction toward the outlet end, these land areas being sized so that at least one would snuggly receive at least one of the outer land areas provided on the different dispensing nozzles and/or tubes. These components when telescoped together establish the substantially leakproof and mechanically constrained connection for conveying the dispensed material. The flat base at the outlet end of the port device had side edges that could be flexed out of the flat, to position the device more closely adjacent an interior structural corner for directing material quite accurately into the corner.

Our copending application Ser. No. 08/503,836 discloses a port device specifically suited to discharge fluid material relative to a crack at a structural corner, either into an exterior corner or onto an exterior corner, with minimum material leaking beyond any underlying crack. Also, this port device can be fitted into a drilled hole or the structural crack itself and then manually secured and sealed relative thereto, suited for dispensing material under high pressure while yet withstanding blow-out from the structure. The application further shows accessory fittings for allowing universality of use of the port device, by establishing operative connections between the material dispensing tube and port device via flexible hoses of virtually any needed length, for dispensing fluid material into cracks spaced at variable distances and orientations from the dispensing tube and eliminating the need for the user to hold the dispensing tool close to and connected to the port device.

SUMMARY OF THE INVENTION

This invention relates to devices for establishing leakproof seated connections with great universality of use with many different types and sizes of dispensing tubes, nozzles, surface ports used in dispensing fluid material from cartridges, for directing such fluid material into cracks in underlying structures.

A basic object of this invention is to provide improved method and apparatus involving multiple piece kits suited in alternate manners of connection for conveying multiple components of a reactive material via isolated flow paths from the component containing cartridges over indefinite distances before mixing the components and then conveying the mixed components over a common flow path typically of significantly shorter length before being discharged where and when needed, and of controlling the material discharge by clamp means on the common flow path proximate the discharging material before such sets.

Another basic object of this invention is to provide for use with material dispensing systems, a modified dispensing tool and an accessory kit including dummy nozzles, hoses, Y tees and fittings for allowing universality of use with different dispensing systems or material cartridges, with different mixing tubes, with different port devices and with varied possible different relative locations of such, by establishing operative separable connections between and via the fitting and the respective dispensing system or cartridge and/or mixing tube and/or port device and/or flexible hoses of virtually any needed length, for dispensing fluid material into cracks or voids at variable distances and/or orientations between the material cartridges and the cracks or voids eliminating the need for the user to hold the dispensing tool close to and connected to the port device.

BRIEF DESCRIPTION OF THE DRAWINGS

These and further objects, advantages and features of the present invention will be understood and appreciated upon reviewing the following disclosure, including as a part thereof the accompanying drawings, in which.

DETAILED DESCRIPTION OF THE INVENTION

Figure 1:
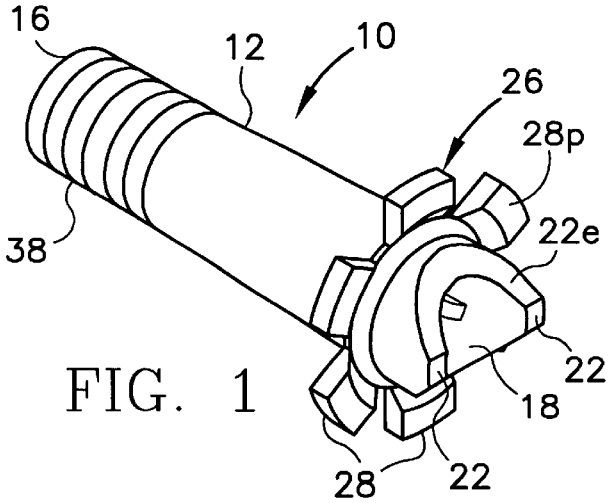
FIG. 1 is a perspective view of a port device according to this invention, as seen from the outlet end thereof.
Figure 2:
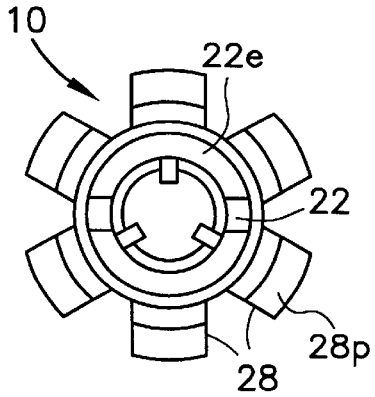
FIG. 2 is an elevational view of port device from the outlet end.
Figure 3:
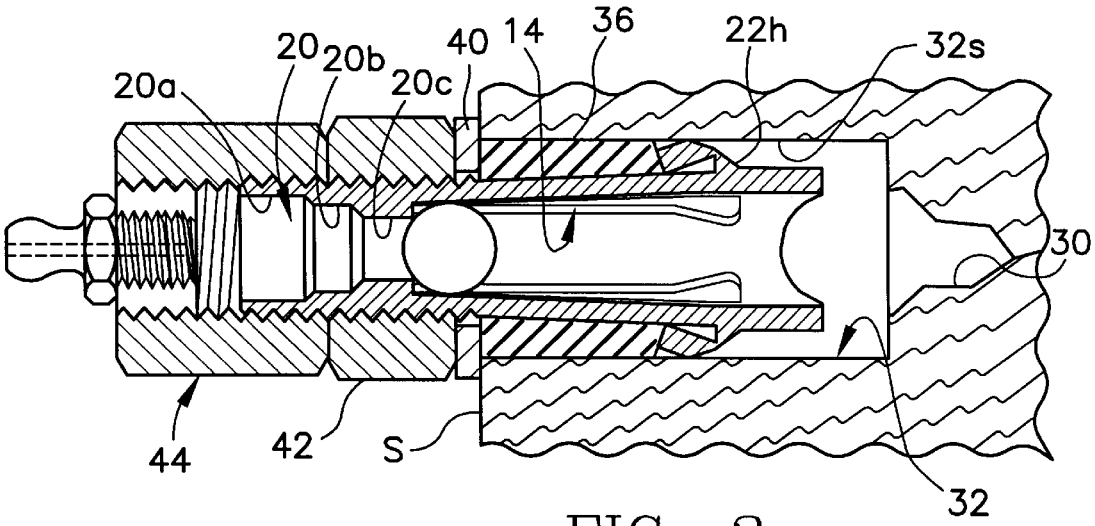
FIG. 3 is a centered sectional view of the port device, operatively in place in a structural crack.

A surface port device 10 is illustrated in FIGS. 1, 2 and 3, comprised as a tube 12 having a throughbore 14 between inlet end 16 and outlet end 18. The bore at the inlet end 16 has a stepped region 20, having three axially adjacent generally cylindrical inner diameter land areas 20*a*, 20*b*, and 20*c* of progressively smaller diameters in moving downstream toward the outlet end 18. The outlet end 18 illustrated has a protruding nose that is beveled from opposite centered high points 22, forming with tube end edges 22*e* a substantially right angle exterior corner. A mounting base 26 is formed on the tube 12 spaced from the outlet end nose and high points 22 in the direction of the inlet end 16; the base being comprised of separate radial blades 28 circumferentially disposed around the tube, and supported from the tube across generally circumferential hinged regions 28*h*. The blades are generally of rectangular shape, to be folded back to lie against the outside of the tube without having side edges of adjacent blades bind against one another; and six blades are illustrated.

With the blades unfolded, the blade pads 28*p* can be bonded or otherwise secured flush against a flat structural surface S, with the outlet nose fitted into a larger underlying crack; or the opposing blades can be folded part way back to have the pads lie flush against and be bonded to structural surfaces at an interior corner (not shown), when the end faces 22 are snugged against the structural surfaces at an interior corner for material discharge directly into an underlying crack with minimum leakage at the corner. A modified port device (not shown) could be provided without the outlet nose projecting beyond the plane of the unfolded blade pads 28*p*, allowing the port device to be bonded against a flat surface (not shown) and aligned over even a small surface crack. Our copending application Ser. No. 08/503,836 illustrates these alternatives.

As also illustrated in FIG. 3, port device 10 can effectively be used for high pressure material fill into a crack 30. This would be possible by drilling a hole 32 in the structure S to reach the crack and sized to accept the port device with the blades 28 folded back against the tube 12. A resilient sleeve 36 of rubber or plastic would be fitted over the tube 12, sized to fit into the hole and extended axially only part way along the tube to threaded region 38, and a washer 40 and nut 42 would be fitted over the tube inlet end. The tube and sleeve would be fitted into the hole 32 until the washer 40 and nut 42 are generally solid against the structure S, whereupon the nut would be tightened onto the tube at the threaded region to withdrawn the tube slightly and axially compress the sleeve 36 and expand it tightly against the hole surfaces of hole 32. This would withstand high discharging material pressures in excess of 1,000 psi. Further, a closure cap 44 having inside threads 45 is threaded onto tube threads 38, the cap also having an opening 46 that accepts a threaded pressure fitting 48 of conventional design. The opening 46 could be threaded, but the closure wall might be sufficiently thin to allow it to be self-threaded when threads 49 of the fitting 49 is twisted into the opening for securing it to the closure cap 44.

As discussed in our U.S. Pat. No. 5,433,354, the stepped inlet region 20 of the port device provides universality in snuggly cooperating with many different types and sizes of dispensing tubes and outlet nozzles used in dispensing fluid material(s) from tubular cartridge(s), and in thereby establishing a leakproof seated connection between the dispensing tube outlet nozzle and port device inlet. The diameters of the dispensing tubes vary, depending on the brand or supplier, and on the material being dispensed, its viscosity and needed rate of mixing and volume of discharge. By way of example, mixing tubes for multiple component systems typically might be of ¼, ⅜or ½inch I.D. or inner diameter and (because of the wall thickness of the tube) a correspondingly larger O.D. or outer diameter, and the outlet nozzle end of each such tube might be configurated as three, four or five smaller stepped cylindrical outer diameter nose sections; and the port stepped region 20 has the land areas 20*a*, 20*b*and 20*c* sized so that at least one of these stepped areas of the nose section can and do snuggly cooperate to establish the leakproof separable connection.

By way of specific example, the port device land area 20*a* can be of substantially 0.375 inch inner diameter with an axial length of substantially 0.185 inch, the land area 20*b* can be of substantially 0.25 inch inner diameter with an axial length of substantially 0.125 inch, and the land area 20*c* can be of substantially 0.165 inch inner diameter.

Figure 5:
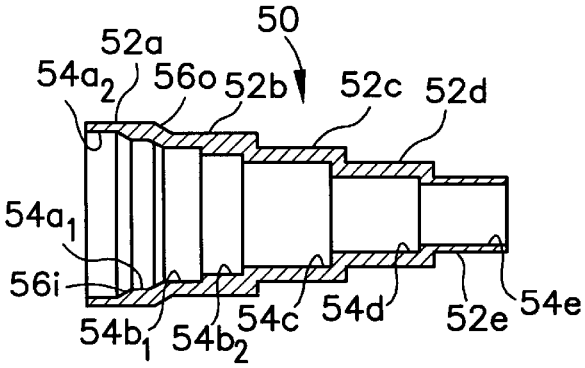
FIG. 5 is a centered section view of an accessory fitting usable with the surface port disclosed herein as well as with conventional material dispensing tools and systems.
Figure 4:
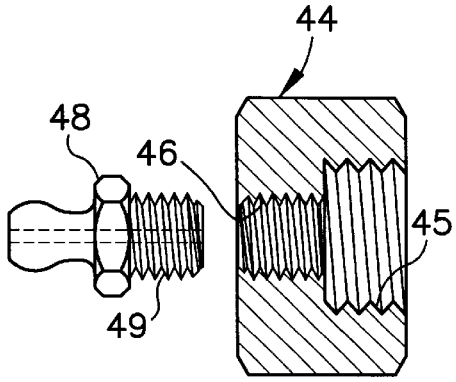
FIG. 4 is a broken away sectional view of components used in the port device of FIG. 3.

Adding to the universality of the port device is the enhanced fitting 50 of FIG. 5. The fitting 50 is tubular, having five stepped exterior land areas 52*a*, 52*b*, 52*c*, 52*d* and 52*e*, with corresponding interior land areas associated with each. The exterior land areas would be made to outer diameters respectively corresponding to the I.D. or interior diameter of different conventional flexible hoses: area 52*b* to snuggly receive a ⅝" hose, 52*c* to receive a ½" hose, 52*d* to receive a ⅜" hose, and 52*e* to receive a ¼" hose. The associated inner diameter land areas would be made to fit snuggly on the outer diameters respectively corresponding to the conventionally used mixing tubes, with axial length of each as needed for firm retention. This, would provide: land area 54*a*1 to snuggly fit over a ½" mixer tube; land areas 54*b*1 and 54*b* 2 to snuggly fit over different types of ⅜" mixer tubes; land area 54*c* to snuggly fit over a ¼" mixer tube; land area 54*d* to snuggly fit over a 3/16" mixer tube, and land area 54*e* being the smallest throughbore of the tube.

Figure 6:
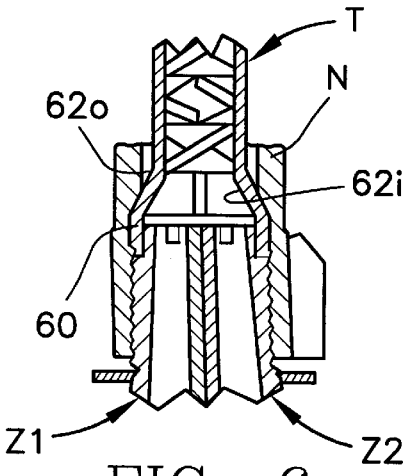
FIG. 6 is a centered section view of adjacent material cartridges illustrating a mixing tube secured over the adjacent outlet nozzles thereof.
Figure 7:
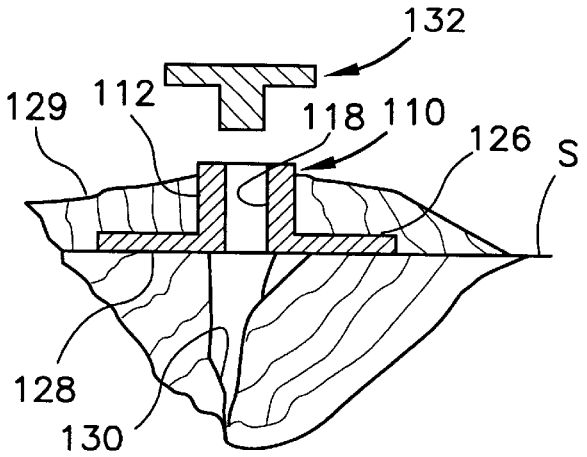
FIG. 7 is a centered section view of an alternative surface port mounted in place over a surface crack in a structure, with a closure plug also shown adjacent thereto but with the port yet open, suited for use with material dispensing fittings and systems disclosed herein.

Of further interest, land area 54*a*2 would be sized and shaped, including conically tapered interior and exterior faces 56*i* and 56*o*, to snuggly fit over and cooperate with the outlet threaded stems or nozzles of conventional Bell housing material dispensing systems or machines and/or adjacent side-by-side material cartridges, where each cartridge has but a semi-cylindrical nozzle and under a retaining nut adapted to be connected onto the mixing tube, etc. FIG. 6 shows adjacent nozzles Z1 and Z2 from adjacent material cartridges (not shown) together that form a threaded stem, and a mixing tube T with a flared inlet end 60 having concially tapered interior and exterior faces 62*i* and 62*o*. The fitting faces 56*i* and 56*o* would correspond to these tube faces respectively, whereby such fitting can become secured to cartridge nozzles via nut N for discharge via the fitting and hoses or the like to remote end use points, as will be noted.

The fitting 50 is thus suited for connection and use directly onto the outlet threaded stems or nozzles of conventional Bell housing material dispensing systems or machines and/or adjacent side-by-side material cartridges, before the mixing tube, to provide for distribution of substantially unmixed materials via a hose to any spaced location and the connection then to the mixing tube for complete mixing of the material for dispensing into a nearby crack (not shown). Alternatively, the fitting can be positioned on and directly connected to the outside body of a material mixer, for connection via a hose to a separated surface port device for filling an underlying crack.

Of particular importance with this latter concept, the following port device 110 is being disclosed as a low cost but viable option of material fill. The port device 110 has plain circular base 126 and an upstanding central hub or short tube 112, and a bore 118 through both opening onto the bottom base surface 128. The port device is of a low silhouette, meaning that base is only approximately 1/16" thick and the tube 112 upstands therefrom between only ¼" and 5/16", leaving the bore possibly 5/16" or ⅜" long. The base surface 128 could be bonded to a structural surface S, but more likely would be held onto the surface by a layer 129 of epoxie, cement or the like overlying the base, while having the throughbore 118 aligned over a crack 130 in said structure. A closure 132 having a plug 133 that can be snugged into the bore 118 and having enlarged flange 134 for pressing and/or removing the plug, can used with this port device to prevent the epoxie layer 129 from entering the bore 118 while securing the port to the surface, or to minimize leakage from the opened bore of the fill material before such sets. An accessory fitting can be separably connected to the port device suited for dispensing material with little leakage into the structure crack and thereafter can be removed, leaving the port device behind but almost hidded under the layer 129 on the structure.

Figure 8:
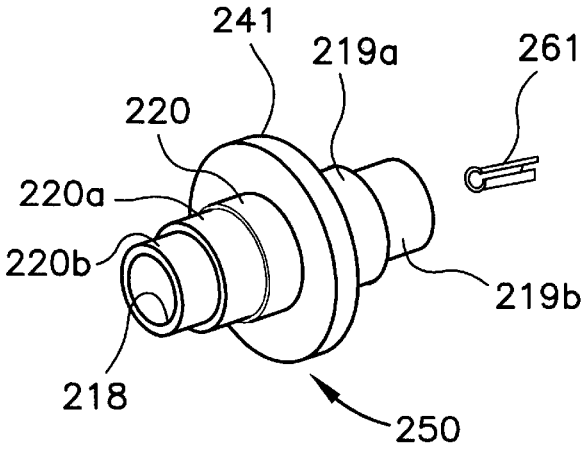
FIG. 8 is a perspective view of different accessory fitting.

The universality of the material dispensing system is further enhanced by fitting 250 illustrated in FIG. 8. The fitting 250 is tubular having two stepped outer land areas 219*a* and 219*b* to correspond to the inner land areas of different port devices or hoses, with outer land area 219*a* sized to mate with the bore 118 of port device 110. A throughbore 218 of generally uniform diameter is sized to accept the O.D of a small preferably ⅛" I.D hose. The exterior of the fitting 250 has outer land areas 220, 220*a* and 220*b*, which could be selectively mate with the inner land areas 20*a* and 20*b* of the port device 10 for establishing separable leakproof joints. As noted, the same outer land areas can be fitted into conventional small hoses used in the industry and clamped in place in a leakproof manner.

Thus, with either or both interior and/or exterior stepped land areas suited for receipt of and cooperation with the land areas of dispensing tubes and/or port devices, or for cooperating with the inside or outside of conventioal hoses, the following assembly can be used with greatly improved ease and efficiency.

Figure 9:
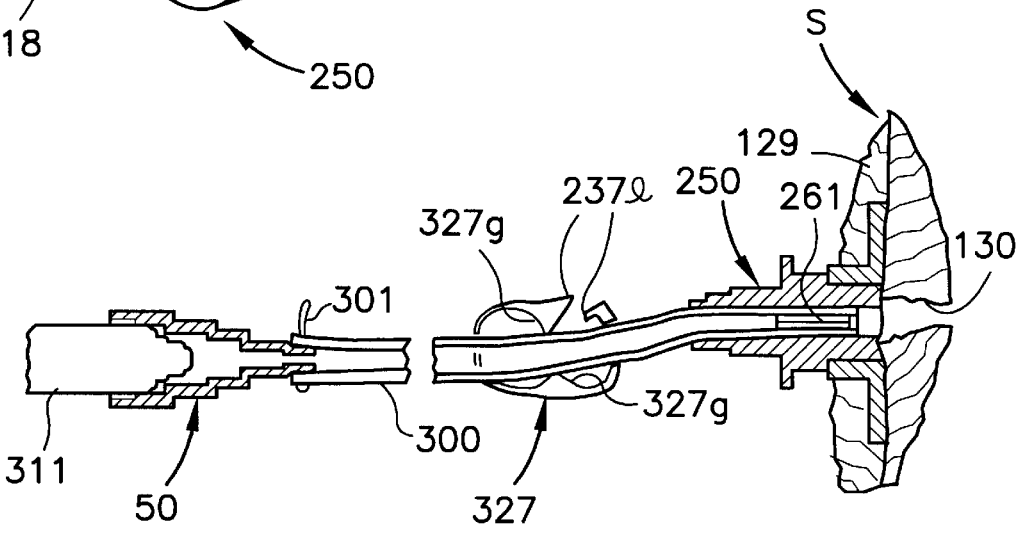
FIG. 9 is a sectional view of different accessory fittings illustrated in an operative connection between a mixing tube and a suitable port device, forming but one material dispensing system possible with the subject invention.

Thus, the fittings 50 and 250 could be connected to the opposite ends of a flexible hose 300, over the exterior land area 52*e* of fitting 50 and held mechanically thereon by a simple conventional spring clip 301, and within the bore 218 of fitting 250 and held mechanically therein by roll pin 261. Further, a conventional pinch clip 327 can be retained on the hose between the fittings, that in the opened position (illustrated in FIG. 9) allows material flow through the hose; while when pinched closed with the grippers 327*g* clamped tightly against the hose to restrict and/or preclude material flow and with the latch areas 2371 engaged to retain the clip closed. Further, the land area 54*a* of the fitting 50 can be snugged on the outer diameter 311 of a ½" I.D. mixing tube T.

It would be possible to activate the pumping mechanism (not shown) for discharging the material through the mixing tube 311, and to control such flow by the pinch clip 327; and further to move the fitting 250 from one premounted port device 250 to another, for filling the same or different cracks quickly and without holding the cartridge tube(s).

Figure 10:
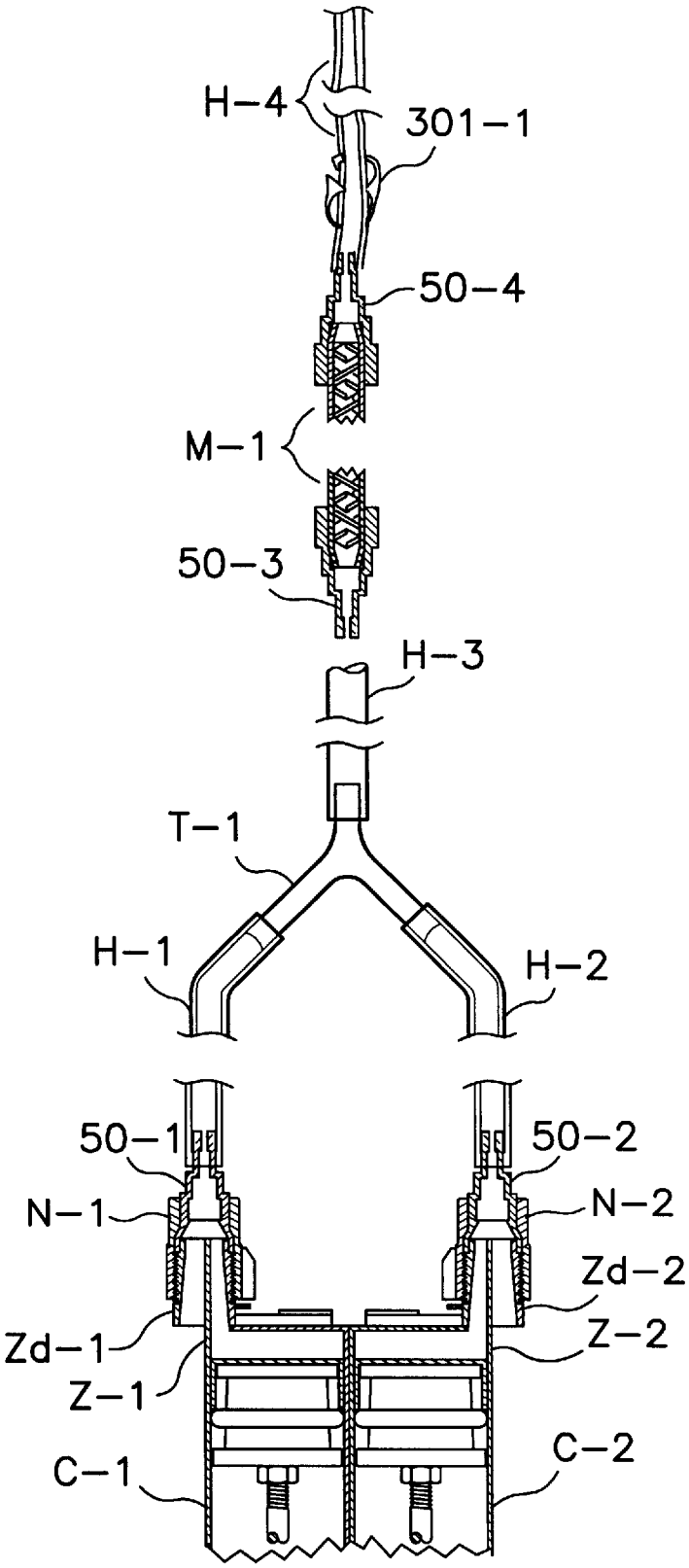
FIGS. 10 and 11 are sectional schematic views of other material dispensing systems possible when using the disclosed accessory fittings disclosed herein.
Figure 11:
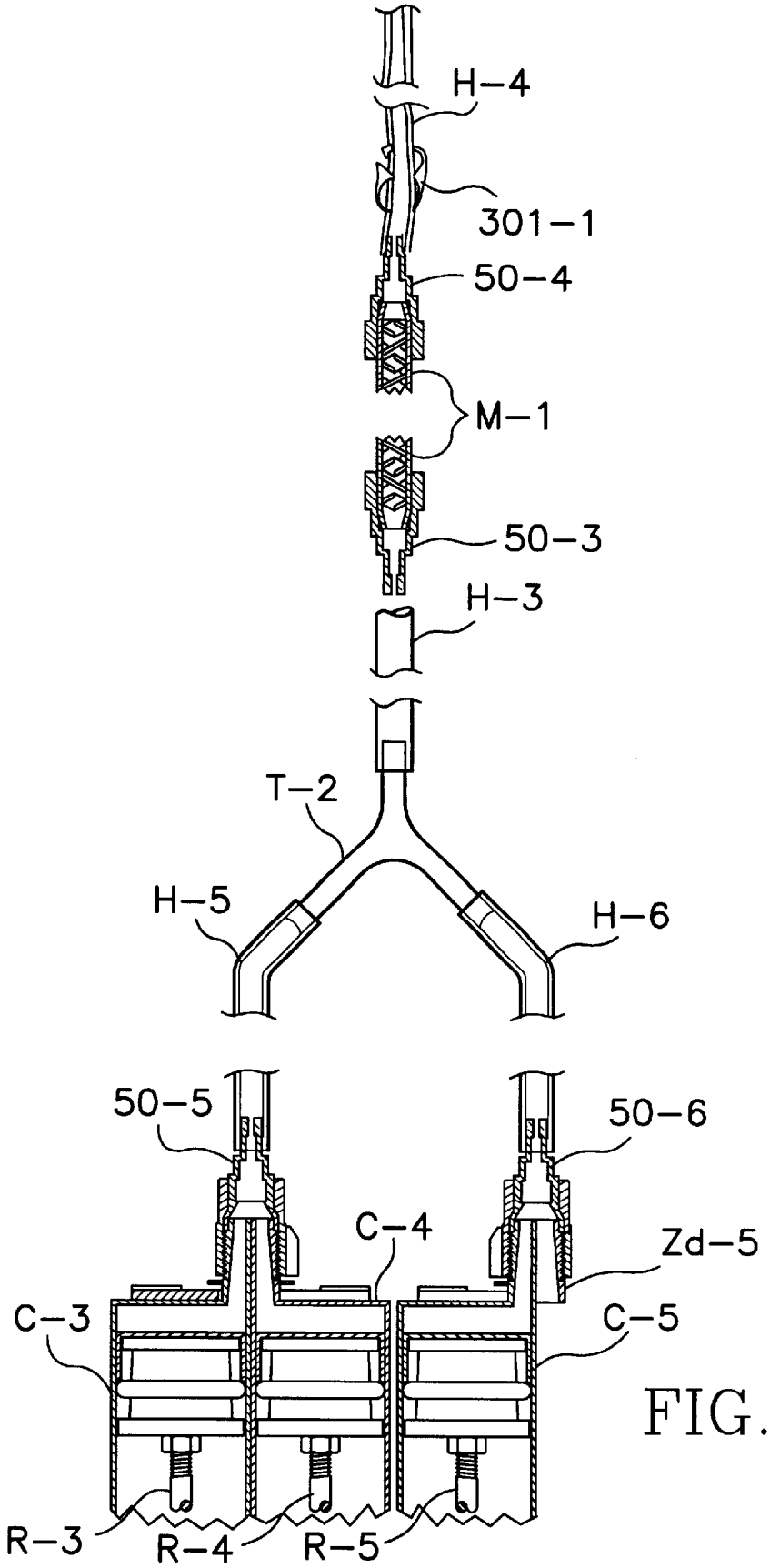

Different combinations of the above mentioned options, and others to be mentioned now, are illustrated in FIGS. 10 and 11.

Figure 13:
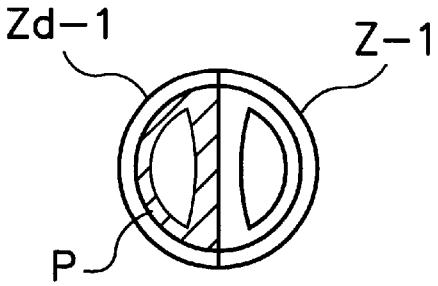
FIG. 13 is a top plan view of adjacent paired nozzles of material filled cartridge and dummy cartridges used in the dispensing systems of FIGS. 10 and 11.

FIG. 10 specifically shows two different material cartridges C-1, C-2, rotated 180 degrees from the normal position with the associated exteriorly threaded semi-cylindrical discharge nozzles Z-1, Z-2 lying adjacent one another to define an exteriorly threaded cylindrical nozzle connection form (see FIG. 6), to alternate positions where the cartridge discharge nozzles are spaced apart and remote from one another. Dummy nozzles Zd-1, Zd-2, sized and shaped to correspond to the conventional cooperating material cartridge nozzles (but without any actual cartridge body), are paired up with the respective filled material cartridge nozzles Z-1, Z-2 to define a related exteriorly threaded cylindrical nozzle connection form (similar to conventionally paired material cartridges of FIG. 6). However, each dummy nozzle Zd-1, Zd-2 has its throughbore closed, to preclude the material discharged from its paired material cartridge from flowing out an open bottom of the dummy nozzle. This closure might be achieved simply by inserting into the dummy nozzle, at the outlet end, a conventional flanged plug "P" (see FIG. 13) of the type normally fitted into the outlet nozzle of the filled material cartridge for its pre-use shipment and storage, or by any other suitable flow blockage means. The dummy nozzles can be made by the same manufacturer of the conventional cartridges, and/or can even be formed as rejects of such cartridges; and accordingly can be permanently sealed closed by the plug "P" being bonded in place during its fabrication.

As illustrated, separate fitting 50-1, 50-2 can be fitted and secured by nuts N-1, N-2 threaded onto the cylindrical exterior of the paired filled cartridge and dummy nozzles, and conventional hoses H-1, H-2 of any size (⅝", ½", ⅜", or ¼") can be fitted over and secured onto the corresponding appropriate exterior land areas (respectively 52*b*, 52*c*, 52*d*, or 52*e*) of the fittings and can be fitted over and secured onto two branches of tee T-1. Another hose H-3 can be connected between the third tee branch and an appropriate exterior land area of fitting 50-3. A mixing tube M-1 (conventional except for having the flared inlet end thereof cut off) can be snugged into sealed connections with fittings 50-3 and 50-4 (with the interior fitting land areas 54*b*1 and 54*b*2, 54*c*, and 54*d* corresponding respectively to the outer diameters of conventional ½", ⅜", ¼" can be secured onto an appropriate exterior land area of fitting 50-4, with pinch clip 301-1 thereon, connected to or proximate an appropriate crack or void (not shown) to be filled with the discharging mixed reactive material.

FIG. 11 shows three cartridges C-3, C-4 and C-5 operated by a dispensing tool having three operating rods R-3, R-4, R-5 connected to the three plungers operating in the respective cartridges (and this arrangement can be achieved with a modification of the tool disclosed in our U.S. Pat. No. 5,314,092 where the middle rod R-4 originally was only a ratchet powered drive rod and was not connected to a plunger). The adjacent cartridges C-3, C-4 are paired and funneled through fitting 50-5 and hose H-5 to tee T-2, while cartridge C-5 is paired with dummy nozzle Zd-5 and directed through fitting 50-6 and hose H-6 to tee T-2; and the outlet flow path from the tee T-2 can be the same as noted in FIG. 10 from the tee T-1.

Of interest, the cartridges C-3 and C-4 can hold the same component, vastly increasing the ratios of the two different components that are possible, the second component being held in cartridge C-5. Conventional or commonly available cartridges might of 750 ml, 600 ml, 150 ml, 75 ml and 30 ml volumes, with proposed mixing ratios of some of the latest reactive materials developed being different from the simple ratios obtained by pairing two of such different cartridges. The combined discharge from two cartridges of the same component increases the available mix ratios when such can be mixed then with the second reactive component discharged from another single cartridge.

Alternatively, the cartridges C-3 and C-4 can hold two different components of a three component reactive material, where such two components might not be reactive or only slowly reactive when blended together in and after fitting 50-5 and hose H-5, or will not be rapidly reactive until after being mixed with the third component being discharged from the C-5 cartridge in and after the tee T-2 and following mixing tube M-1.

The illustrated conveyance of separate components from the material cartridges over possible long distances before being mixed via the tees T-1, T-2 and mixing tube M-1, and the comparatively short mixed conveyance path after the mixing tube via hose 301-1 before being discharged, would be most appropriate for fast setting multiple component materials now commonly used. Further, the control of the mixed reactive component material discharge by and past a pinch clamp remotely of the component cartridges and/or discharging tool is effective for accurate and intermittent control of the material discharge in close proximity of the crack or void to be filled; and also for keeping the components before they are actually mixed together under more uniform pumped pressures, the latter being of importance in maintaining the intended mix ratios of the components more uniform. Should the mixed components in the mixing tube M-1 and downstream hoses set H-4 prematurely set, complete replacement of such physical pieces is easy and would represent a small investment to replace, as such pieces are generally generic and readily available in the needed size (diameter and length) and quality, and the upstream premixed components would not also be automatically mixed and wasted. The kit aspect of the invention is applicable as the cartridge and dummy nozzles, hoses, tees, pinch clamps, mixing tubes, etc. are standard and available off the shelf, while the fittings 50 are suited to fit universally in different manners (seated over and/or into) with each and all of the needed physical structures.

Figure 12:
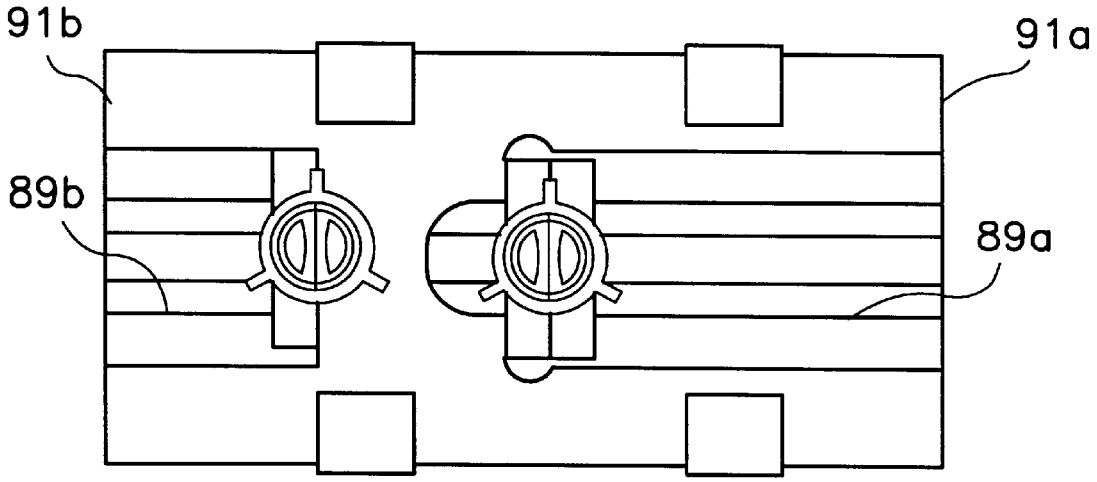
FIG. 12 is a plan view of a front plate on a powered dispensing tool suited for holding the component cartridges in the material dispensing systems of FIGS. 10 and 11.

The front plate 88 illustrated in FIG. 12 might be mounted on a powered dispensing tool, with opposing slots 89*a* and 89*b* formed thereon, suited for holding the component cartridges in the material dispensing systems of FIGS. 10 and 11. The slot 89*a* might be conventional, extended from the plate edge 91*a* to the approximate center of the plate, for having two conventionally paired filled component cartridges fitted into the tool with sideways movement from edge 91*a*. The slot 89*b* might be newly added, extended from the plate edge 91*b* only a short way toward the plate center, sufficient only for having one filled component cartridge and its paired dummy nozzle fitted into the tool with only slight sideways movement in from edge 91*b*. The slots can be extended down the middle of the top plate. Our above mentioned U.S. Pat. No. 5,314,092 shows added general details of the slot and cartridge constructions, and their relative cooperation, which other than the locations thereof as shown herein would be conventional.

The plug P for closing the dummy nozzle is schematically shown in FIG. 12, which illustrates a typical dummy nozzle and a paired filled conventional material filled cartridge nozzle.

Details of construction not given herein, are disclosed in our above-mentioned U.S. Pat. No. 5,433,354. This could include the check ball "B" held captive in the tube bore 14.

While only specific embodiments of the invention have been illustrated, it is apparent that variations may be made therefrom without departing from the inventive concept. Accordingly, the invention is to be limited only by the scope of the following claims.

What is claimed as our invention is:

1. Method for dispensing a multiple component reactive material from two cartridges each having an exteriorly threaded semi-cylindrical outlet nozzle, comprising the steps of positioning the cartridges with the outlet nozzles spaced from one another and pairing each semi-cylindrical outlet nozzle up with an equal size exteriorly threaded semi-cylindrical dummy nozzle having no effective outlet but together defining an exteriorly threaded cylindrical nozzle;

utilizing a fitting and retaining nut over each of the paired now cylindrical cartridge and dummy nozzles, and hoses connected thereon, for defining a separate flow path from each of the paired cartridge and dummy nozzles extended to locations substantially spaced from the nozzles; and combining the separate flow paths at the spaced locations and mixing the separate components thereat and defining a common flow path for the mixed components to close proximity of the intended use of the material.

2. Method for dispensing a multiple component reactive material from two cartridges according to claim 1, comprising further using closure means on the common flow path for regulating the material discharged from the component cartridges at a location proximate the intended use of the material.

3. Apparatus for dispensing a multiple component reactive material from two cartridges each having an exteriorly threaded semi-cylindrical outlet nozzle, comprising the steps of means for holding the cartridges in side-by-side relation with the outlet nozzles thereof being spaced from one another;

a pair of complementary dummy nozzles each of an exteriorly threaded semi-cylindrical shape but without an effective outlet, and means for holding the respective cartridge and dummy nozzles in paired up side-by-side relation and defining thereby a pair of exteriorly threaded cylindrical nozzles;

a pair of fittings each sized to overlie each cylindrical nozzle body in sealed relation, hoses from the fittings for defining separate flow paths for components, a tee for accepting connections of the hoses at locations substantially spaced from the nozzles, and another hose from the tee having flow of the combined components;

a mixer effective for mixing the separate components and having an exterior body between inlet and outlets end; and a pair of other fittings each sized to overlie and seal onto the mixer body at the respective inlet and outlet ends, and a hose from the outlet end fitting for defining a flow path for the mixed components to close proximity of the intended use of the material.

4. A fitting for dispensing a multiple component reactive material from two cartridges according to claim 3, further comprising closure means on the common flow path for regulating the material discharged from the component cartridges at a location proximate the intended use of the material.

5. Apparatus for dispensing a multiple component reactive material from two cartridges according to claim 3, further comprising all of said fittings being of the same configuration.

6. Apparatus for dispensing a multiple component reactive material from three cartridges each having an exteriorly threaded semi-cylindrical outlet nozzle, comprising the steps of means for holding the cartridges in side-by-side relation with the outlet nozzles of at least one of the cartridges being spaced from the others;

a complementary dummy nozzle having an exteriorly threaded semi-cylindrical shape but without an effective outlet, and means for holding the one cartridge and dummy nozzles in side-by-side paired up relation and defining thereby an exteriorly threaded cylindrical nozzle;

a pair of fittings each sized to overlie each cylindrical nozzle body in sealed relation, hoses from the fittings for defining separate flow paths for the components, a tee for accepting connections of the hoses at locations substantially spaced from the nozzles, and another hose from the tee having flow of the combined components;

a mixer effective for mixing the separate components and having an exterior body between inlet and outlets end; and a pair of other fittings each sized to overlie and seal onto the mixer body at the respective inlet and outlet ends, and a hose from the outlet end fitting for defining a flow path for the mixed components to close proximity of the intended use of the material.

7. Apparatus for dispensing a multiple component reactive material from two cartridges according to claim 6, further comprising all of said fittings being of the same configuration.

8. A fitting for dispensing a multiple component reactive material from two cartridges according to claim 7, further comprising closure means on the common flow path for regulating the material discharged from the component cartridges at a location proximate the intended use of the material.

9. Apparatus for dispensing a multiple component reactive material from two cartridges according to claim 8, further comprising all of said fittings having four opposed outer and inner generally cylindrical land areas between its opposite ends.

* * * * *